US010435919B2

(12) United States Patent
Pelaez

(10) Patent No.: US 10,435,919 B2
(45) Date of Patent: Oct. 8, 2019

(54) ANTI-VANDALISM PADLOCK

(71) Applicant: Alejandro Esteban Pelaez, Rio Negro (AR)

(72) Inventor: Alejandro Esteban Pelaez, Rio Negro (AR)

( * ) Notice: Subject to any disclaimer, the term of this patent is extended or adjusted under 35 U.S.C. 154(b) by 0 days.

(21) Appl. No.: 15/507,664

(22) PCT Filed: Aug. 6, 2015

(86) PCT No.: PCT/EP2015/001622
§ 371 (c)(1),
(2) Date: Feb. 28, 2017

(87) PCT Pub. No.: WO2016/029991
PCT Pub. Date: Mar. 3, 2016

(65) Prior Publication Data

US 2017/0284133 A1 Oct. 5, 2017

(30) Foreign Application Priority Data

Aug. 29, 2014 (AR) ..... P20140103255

(51) Int. Cl.

| | |
|---|---|
| ***E05B 67/00*** | (2006.01) |
| ***E05B 67/36*** | (2006.01) |
| ***E05B 63/04*** | (2006.01) |
| ***E05C 7/04*** | (2006.01) |
| ***E05B 67/06*** | (2006.01) |
| *E05B 47/00* | (2006.01) |

(52) U.S. Cl.
CPC ..... *E05B 67/36* (2013.01); *E05B 63/042* (2013.01); *E05B 67/06* (2013.01); *E05C 7/04* (2013.01); *E05B 47/00* (2013.01); *E05B 67/00* (2013.01); *E05B 2047/0094* (2013.01); *E05B 2047/0095* (2013.01)

(58) Field of Classification Search
CPC ..... E05B 67/36; E05B 67/06; E05B 63/042; E05B 67/00; E05B 47/00; E05C 7/04
USPC ..... 70/14, 18, 30, 49, 52, 232
See application file for complete search history.

(56) References Cited

U.S. PATENT DOCUMENTS

| | | | | | |
|---|---|---|---|---|---|
| 4,112,716 | A * | 9/1978 | Wippich | E05B 67/003 | 70/38 C |
| 4,347,720 | A * | 9/1982 | Kenyon | E05B 67/003 | 70/14 |
| 4,777,811 | A * | 10/1988 | Binkley | F16B 41/005 | 70/178 |
| 5,193,366 | A * | 3/1993 | Brinkman | E05B 73/00 | 70/178 |
| 5,201,202 | A * | 4/1993 | Kam | E05B 13/001 | 70/168 |

(Continued)

FOREIGN PATENT DOCUMENTS

| | | | | |
|---|---|---|---|---|
| DE | 9404326 U1 * | 5/1994 | ..... | E05B 67/36 |
| DE | 4436053 A1 | 4/1996 | | |
| GB | 2414034 A | 11/2005 | | |

*Primary Examiner* — Suzanne L Barrett

(74) *Attorney, Agent, or Firm* — Cotman IP Law Group, PLC

(57) ABSTRACT

Anti-vandalism padlocks are used to secure chains, latches or similar elements, consisting of two coupling armors, with a particular geometry according to their application, with a tumbler cam lock. This padlock does not have an exposed shackle nor any other similar element which may be subject to violation either by cutting, lever movements or the like.

21 Claims, 16 Drawing Sheets

(56) References Cited

U.S. PATENT DOCUMENTS

| | | | | | |
|---|---|---|---|---|---|
| 5,361,613 | A * | 11/1994 | Fort | B60R 25/0221 | 70/202 |
| 5,775,747 | A * | 7/1998 | Navarsky | E05B 13/002 | 292/307 B |
| 5,845,520 | A * | 12/1998 | Dolev | E05B 67/32 | 70/37 |
| 7,836,734 | B2 * | 11/2010 | Lynch | B63B 35/7933 | 441/74 |
| 8,938,997 | B2 * | 1/2015 | Piccoli | E05B 73/0029 | 70/14 |
| 9,169,670 | B2 * | 10/2015 | Shute | E05B 45/005 | |
| 10,047,547 | B2 * | 8/2018 | Waugh | E05B 67/003 | |
| 2006/0123856 | A1 | 6/2006 | Loughlin et al. | | |

* cited by examiner

ANTI-VANDALISM PADLOCK

BACKGROUND OF THE INVENTION

1. Field of the Invention

This invention relates to an anti-vandalism padlock used to secure chains, latches or the like, which provides special protection against opening or violation due to its special construction.

Padlocks have been used for centuries. Their history dates back to the end of the XVII century when Federico Javier Pittóm founded a factory in Stjünsund (Stamsund), a village located in one of the islands of the current Norwegian territory, where he invented and manufactured, among other elements, a padlock known as the Scandinavian "Polhem". Two centuries and a half later, Harry Soref founded the company Master Lock and in 1921 he patented a padlock, updating the Scandinavian model. In April 1924 he sold the padlock patent. Soref's padlock was strong and cheap because it was covered by layers of a kind of metal similar to the one used for the construction of bank doors. He later introduced the same padlock using laminated steel.

By definition, a padlock is a safety device used as a portable lock when doors are not equipped with a lock themselves, or when, for practical or economic reasons there is no conventional lock. Actually, a padlock is generally much cheaper and much easier to use. A padlock is especially suitable for large metallic doors that are locked with steel chains. In order to close that kind of doors, a padlock is used by inserting its shackle through the chain links and locking it.

Padlocks may be used in a wide variety of everyday activities, mainly for doors that are not commonly used, to prevent thieves or intruders from trespassing private property, burglaries, sabotages and other acts of vandalism. The most sophisticated and the biggest padlocks are used to block metallic doors locked with chains.

Padlocks are so popular and massive that it would not make much sense to describe those currently used. However, just for the sake of naming their parts, we can say that padlocks are composed of a solid body with a locking mechanism inside to close and block the shackle. The shackle is inserted through the links of at least one chain or directly in a latch. Regarding the closing mechanism, technological advances have spared the need of keys. Nowadays padlocks may be closed using mechanical passwords (combinations), electronic passwords, or even fingerprint scanners (known as digital padlocks, owned by Mintpass), which simply recognize the registered users' fingerprint in order to open.

However, in spite of their long history, current padlocks have a weak spot, which, despite many attempts, has never been improved. For both conventional and unconventional padlocks, the drawback is that the shackle is exposed. This happens even in the case of armored padlocks. Even when the length of the exposed shackle is reduced, there is always a part of it that remains exposed to being cut with manual, pneumatic or hydraulic scissors or pliers. Similarly, padlocks are violated with cutting tools such as saws of longitudinal or circular teeth, broken by impacts or unlocked with lever movements. The same may be achieved by using abrasive cutting elements, such as manual files or electric elements or elements otherwise fed such as "Dremel" portable stones or circular grinders.

2. Description of the Related Art

In all of these cases the drawback to date is the same: the shackle remains exposed either totally or partially and therefore burglaries or acts of vandalism cannot be prevented. For example, this is the case for document US2006123856 describing a lock comprising an exposed shackle.

This revolutionary and easy-to-use invention has come to eliminate this drawback.

Documents DE4436053 and GB2414034 describe additional padlocks that does not comprise shackles, but indentations adapted to receive either straight or curved elements to link. Contrary to the prior art, the invention concerns a padlock that does not comprise shackles, but indentations adapted to receive both straight or curved elements to link.

SUMMARY OF THE INVENTION

The purposes of this invention are firstly, to create an anti-vandalism padlock which does not use a shackle to link elements; secondly, to create an anti-vandalism padlock with a closing system that encloses both of the linked elements; thirdly, to create an anti-vandalism padlock with a decorative and aesthetic shape, upgrading the existing ones; fourthly, this invention is intended to set the basis for a new concept of padlocks, with multiple uses and a higher level of security; finally, this invention is aimed at creating an anti-vandalism padlock with a spherical geometric exterior shape, and a uniform rigidity in all its exterior surface, all of which is aimed at preventing the padlock from being subject to acts of violence.

DETAILED DESCRIPTION OF THE PREFERRED EMBODIMENT

Figure 1:
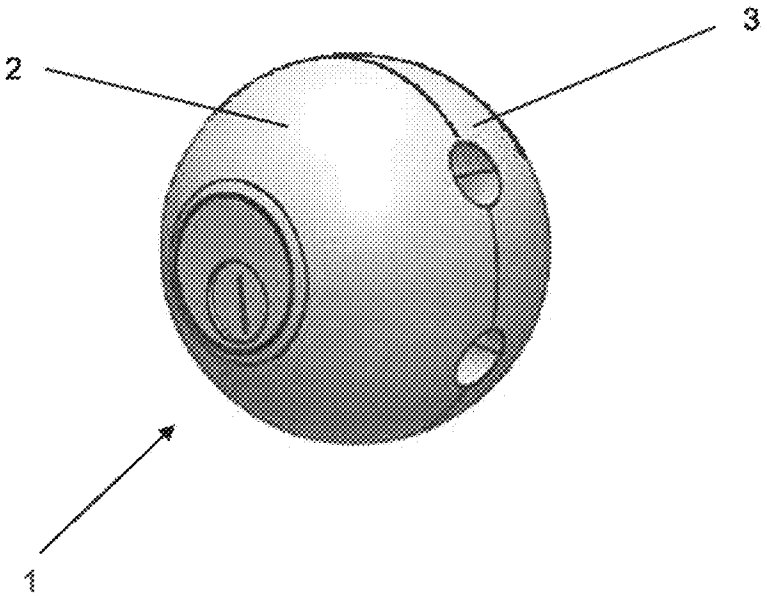
FIG. 1 shows an overall perspective view of an example of a closed anti-vandalism padlock.

The following description will be supported by FIGS. 1 through 5 in order to make it clear and comprehensible.

Due to the fact that padlocks may be used to link the extremes of one of more chains, latches or the like or a combination of both, from now on they will be referred to as "elements to link". This is worth mentioning because it would be incorrect to refer to padlocks as "elements to secure" as chains, latches, etc. are the elements used to secure other elements (money, private property, luggage, etc.). For the example, the first element to link is the first link of a chain, referred to as 16 and the second element to link is the second link of a chain, referred to as 16'. Padlock 1 may be used, for example, to lock a double gate with a latch in each of the two parts of the gate or one latch attached to a wall and the other one to the gate.

Anti-vandalism padlock 1 has an anterior armor 2, a posterior armor 3 and a tumbler cam lock 4. The cutting faces of the anterior armor 2 and the posterior armor 3 are mutually attached. In this way, they both conform only one structure. The tumbler cam lock 4 is inserted from the exterior face of the anterior armor 2, to the plain cutting face of said armor through a passing aperture 10 on the symmetry axis of the anterior armor 2. The tumbler cam lock 4 is also inserted through one non-passing aperture 9 projected out with the symmetry axis of the posterior armor 3, inserted from the plain cutting face of the posterior armor 3 to the interior of said armor. The features of the tumbler cam lock 4 will be dealt with later. In the meantime, it is worth mentioning that the tumbler cam lock 4 is the means of attachment between the anterior armor 2 and the posterior armor 3.

As it was mentioned earlier, the main advantage of example 1 of anti-vandalism padlocks of this invention is the absence of a shackle and therefore the lack of exposure to violation. To this end, the interlocking relationship between a first element to link 16 and a second element to link 16', is placed between the plain cutting faces of the anterior armor 2 and the posterior armor 3.

The said interlocking relationship between the first element to link 16 and the second element to link 16' is partially defined in the anterior armor 2 and the posterior armor 3, which are complementary when they are interlocked.

Figure 4:
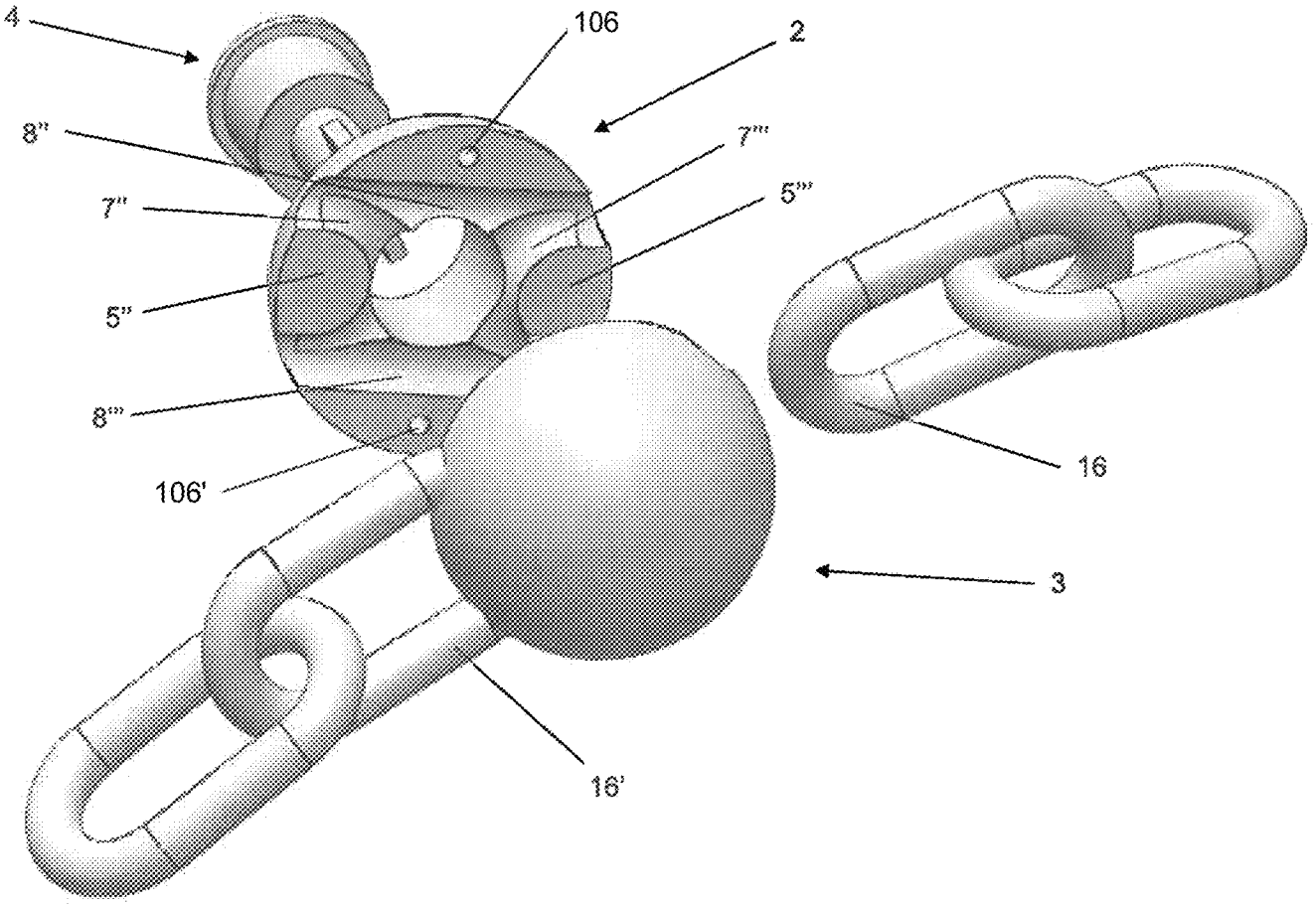
FIG. 4 shows each piece of the example of anti-vandalism padlock separately, from the opposite angle than that of FIG. 2 and 3, in order to show other aspects of it. In this case the FIG. also shows a chain ready to be secured.
Figure 5:
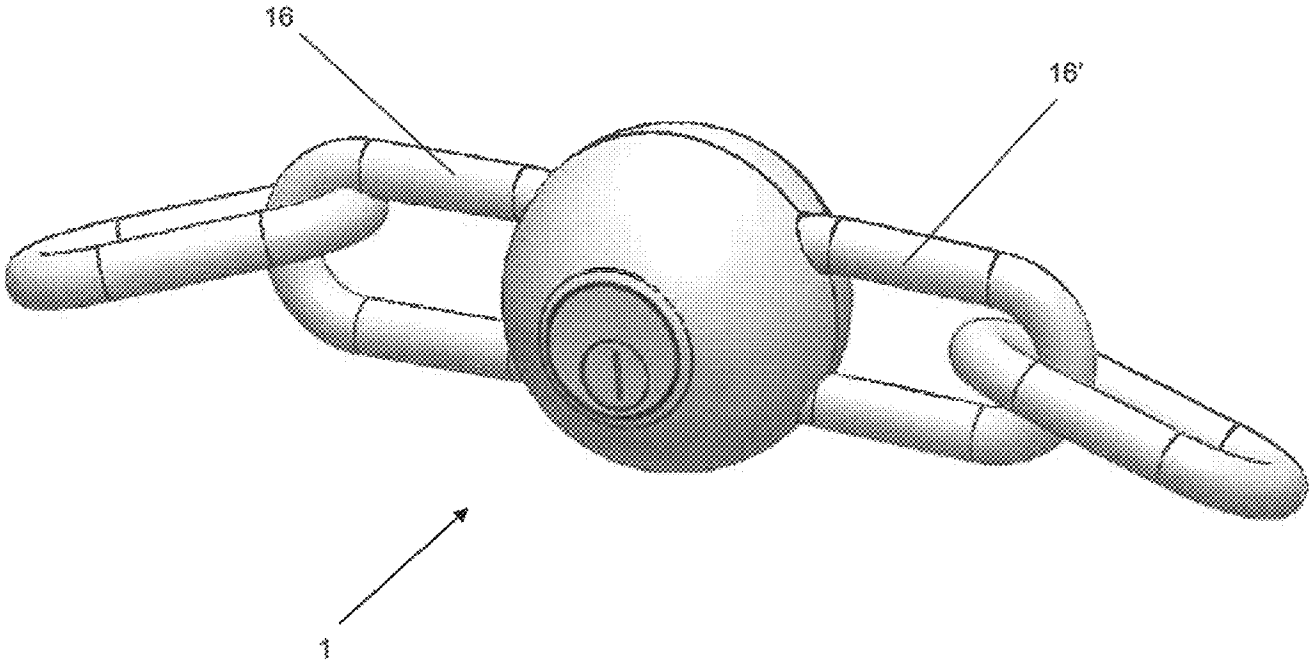
FIG. 5 shows the example of a closed anti-vandalism padlock, securing 2 chains or the extremes of the same chain.

The description above can be clearly seen in FIG. 4.

In the case of the anterior armor 2, the interlocking relationship is defined by a first curved semicircular indentation 7" and a second curved semicircular indentation 7'". These curved indentations 7" and 7'" have their axis of radius geometrically placed on the perimeter of the plain cutting face and opposite to each other. In order to be completely opposite, they are placed in a 180° angle between each other. Considering the previously mentioned aperture 10 and indentations 7" and 7'", a first plain protrusion 5" and a second plain protrusion 5'" are defined diametrically opposite to each other. The angular disposition of protrusions 5" and 5'" will depend on the application for which the padlock was created. Therefore these protrusions need not always be at exactly 180°, they may be geometrically placed in a different angle, even at 90° so that both of the elements to link 16 and 16' are inserted with this angle. Furthermore, they could be at 360°, in which case both protrusions 5" and 5'" would be parallel to each other.

Figure 2:
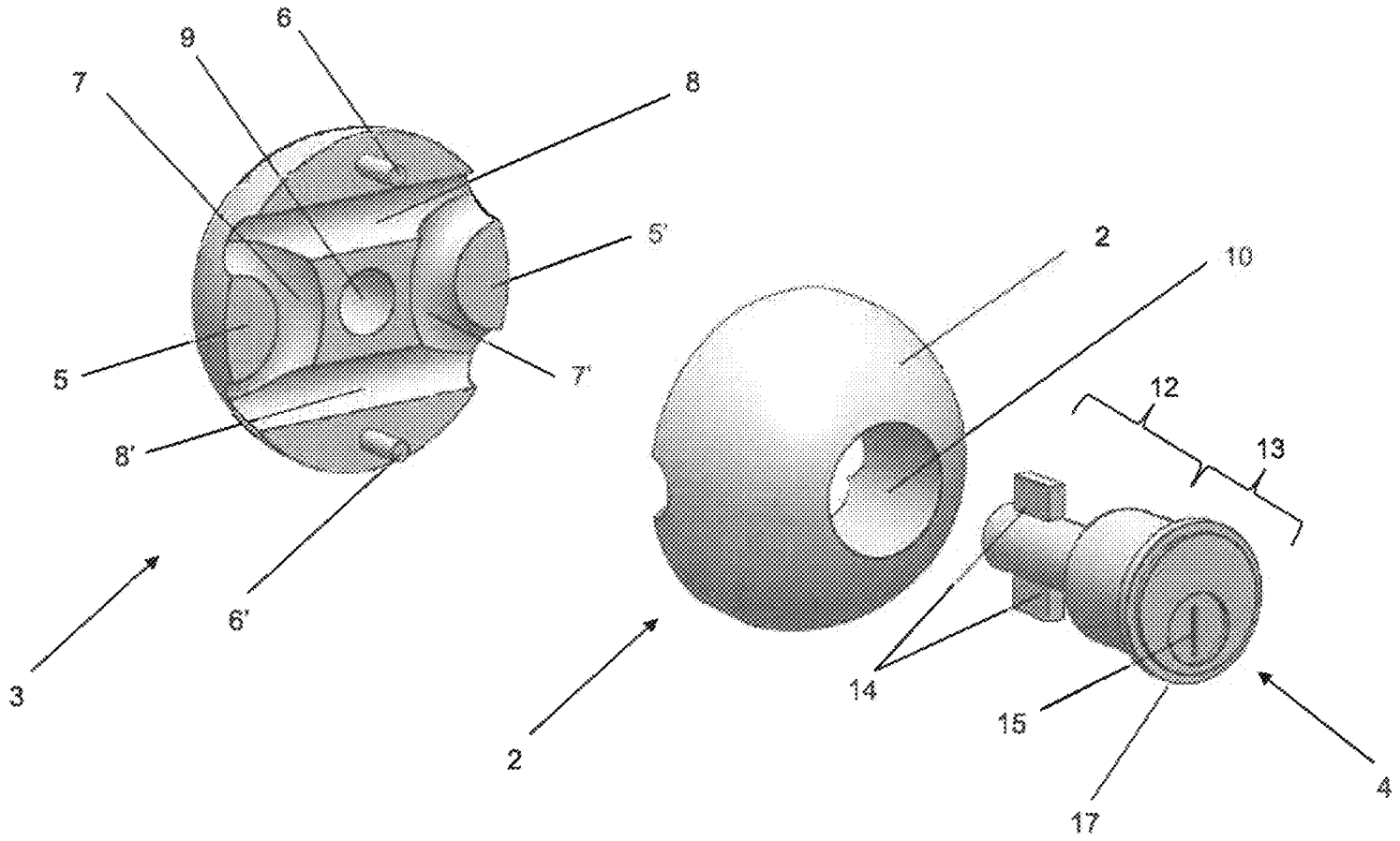
FIG. 2 shows each of the three basic pieces of the example of anti-vandalism padlock mentioned above, open and with the stick off.
Figure 3:
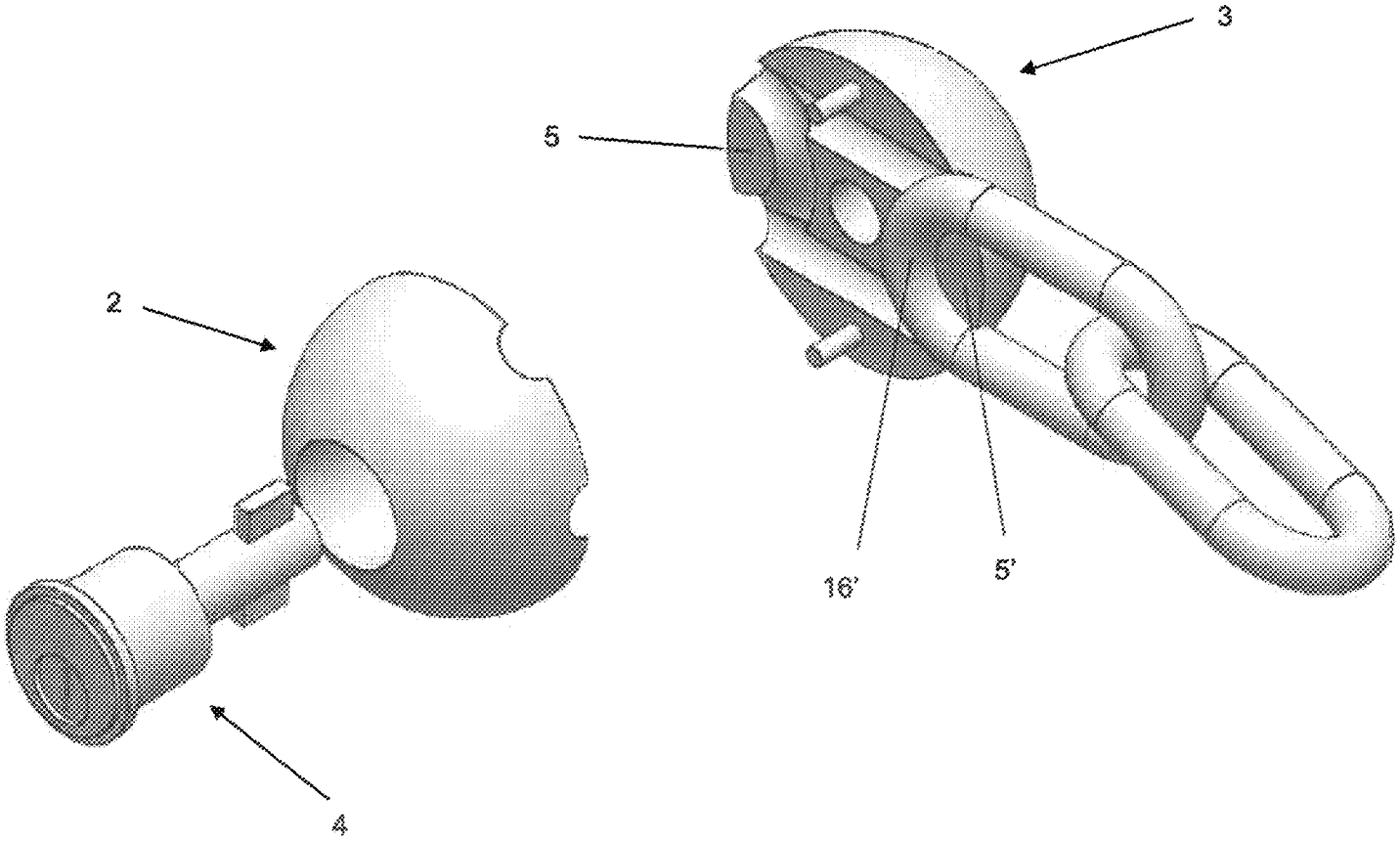
FIG. 3 shows a view similar to the one in FIG. 2. In this case the padlock is inserted in a link of a chain.

The following description may be clearly seen in FIG. 2.

Regarding posterior armor 3, the interlocking relationship is defined by the first curved semicircular indentation 7 and the second curved semicircular protrusion 7'. These curved indentation 7 and 7" have their axis of radius geometrically placed on the perimeter of the plain cutting face and in the opposite way (at a 180° angle, as an example). This way, just as in the case of anterior armor 2, a first plain protrusion 5 and a second plain protrusion 5' are defined on the cutting face of posterior armor 3 in an opposite way.

Apart from the angular disposition, which, as it was mentioned before, depends on the application of the padlock, there must be absolute symmetry between the anterior armor 2 and the posterior armor 3 so that the first and the second protrusions 5 and 5' on the posterior armor 3 are respectively coupled with the first and the second protrusions 5" and 5'" on the anterior armor 2.

The type of indentations and protrusions described above allows to place the first element to link 16 (which in this example is the extreme of a chain), due to the joint action of protrusions 5 and 5'" and curved indentations 7 and 7'". While the second element to link 16' (which in this example is the other extreme of the same chain), will be coupled due to the joint action of protrusions 5' and 5" and curved indentations 7' and 7".

In accordance with the paragraph above, the same would happen if the first element to link 16 and the second element to link 16' are links in the extremes of two different chains.

In example 1 of the anti-vandalism padlock, the interlocking means between the first element to link 16 and the second element to link 16' are defined, in the anterior armor 2, by a first straight indentation 8" and a second straight indentation 8'", which are parallel to each other; while, in the posterior armor 3, the interlocking means are defined by a first straight indentation 8 and a second straight indentation 8', both parallel to each other. In this way, these first and second straight indentations 8 and 8', couple with the respective first and second straight indentations 8" and 8'" in the anterior armor 2. That is to say, indentations 8 and 8' couple with indentations 8" and 8'". This is the case in which it is necessary to securely link straight elements, for instance latches of a door or gate, a toolbox, etc.

Figure 6:
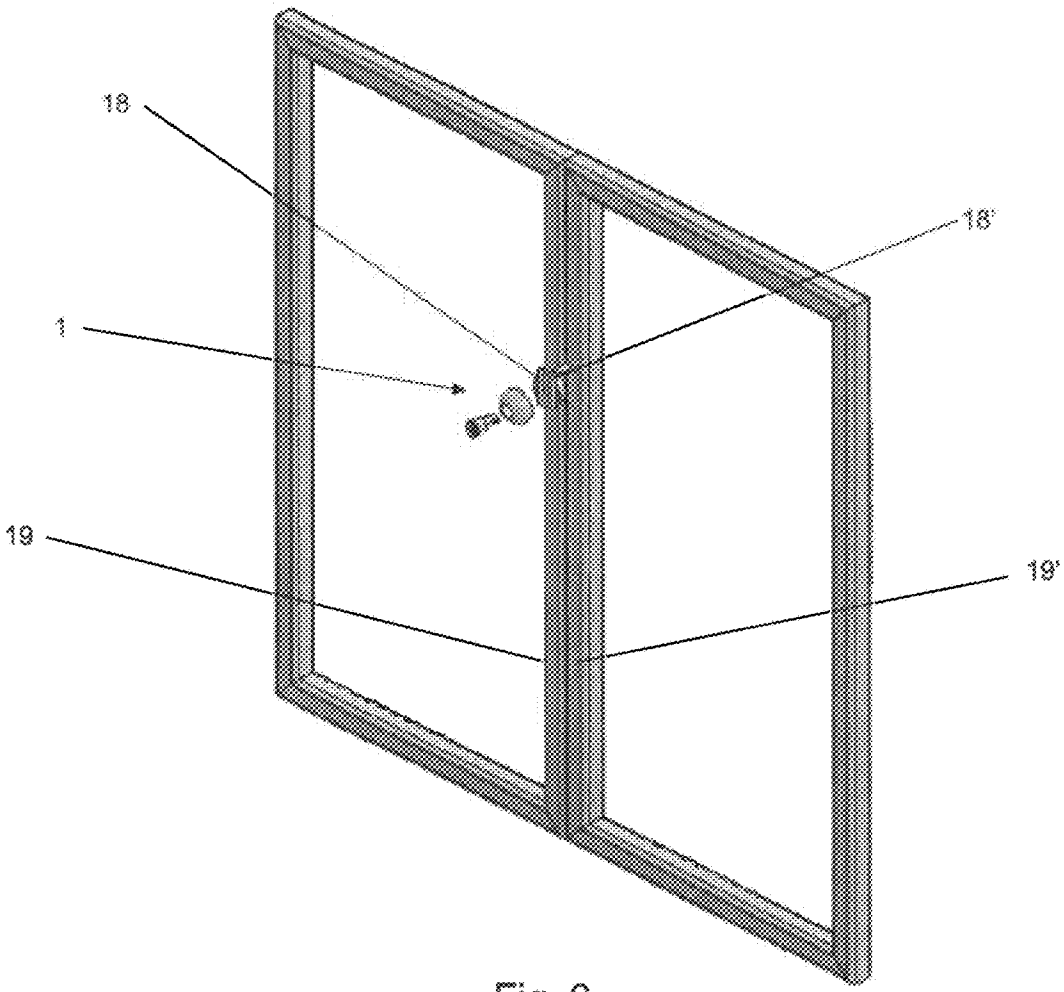
FIG. 6 shows the separate pieces of an example of an open spherical anti-vandalism padlock, locking the latch of a double gate.

FIG. 6 shows an example of application of padlocks to link straight elements. Said FIG. shows a spherical anti-vandalism padlock 1, in its open form and its separate pieces, used to link two straight latches 18 and 18' attached to both doors 19 and 19' of a double gate.

In the design, as shown with the example in FIGS. 1 through 5, padlocks able to function interchangeably with curved and straight interlocking means are more versatile. To this end, from the construction point of view, the first straight indentation 8" and the second straight indentation 8'" defined on the cutting face of anterior armor 2, project out from the respective superior and inferior extremes of the first curved indentation 7" and the second curved indentation 7'". While in the cutting face of posterior armor 3, the first straight indentation 8 and the second straight indentation 81 project out from the respective superior and inferior extremes of the first curved indentation 7 and the second curved indentation 7'.

In line with the paragraphs above, there follow the construction details of the tumbler cam lock 4. The tumbler cam lock is cylindrical. Along its geometry, the first anterior part is narrow, with a maximum diameter of 17, which cannot be inserted in the passing aperture 10 on the symmetry axis of the anterior armor 2. The second part has a medium diameter 13, which can be inserted in the passing aperture 10 on the symmetry axis of the anterior armor 2. Further along its geometry, the tumbler cam lock also comprises a third posterior part with a narrower diameter 12, which can be inserted in aperture 9 of the posterior armor 3. The anchorage means 14 are placed in this third posterior narrower part 12. These allow the tumbler cam lock to couple with the posterior armor 9 in a safe way. In this way, the blocking system of this revolutionary padlock consists of the joint action of the first part of the tumbler cam lock, with a wider diameter 17 which blocks the movement of the anterior arm—armor our 2 and the anchorage means 14 which have the same function for the posterior armor 3.

The anchorage means 14 may consist of pallets, bolts or any other closing means. Needless to say, the posterior armor 3 must have the internal shape necessary to enclose said anchorage means 14. Nevertheless, this detail is irrelevant because it will depend on the type of anchorage means. It even depends on the selected type of tumbler cam lock 4 being that the tumbler may be taken from a generic one or it may be an adaptation of the tumblers in the market.

Both the padlock locking and unlocking depend on the position of the bolt 15. It may be switched from the "open" or "closed" positions using a key or a similar element characteristic of the tumbler cam lock.

It is worth mentioning that the type of mechanism used by the tumbler cam lock does not limit the invention. That is to say that for the example, the tumbler cam lock used was a standard one which opens with a key. However, the tumbler cam lock appropriate for a "digital padlock" could be one operated by fingerprint recognition, by entering a numeric code, by a radio frequency identification card, Bluetooth® connection through software code validation installed in the cellphone of the padlock user, etc.

Notwithstanding the drawings there are no suggestions for the geometric exterior shape of the anterior 2 and posterior 3 armors. They could be cubic, cylindrical, etc., depending on the application of the padlock. However, it is worth mentioning that the anterior 2 and posterior 3 armors of the padlock in example 1 are perfect hemispheres externally. In this way, when coupled, the anterior 2 and posterior 3 armors define a perfect spherical external geometric structure. This feature makes the closed padlock difficult to handle in order to violate it, increasing its safety level.

As it is shown in the drawings, between the cutting faces of the anterior armor 2 and the posterior armor 3, there may exist centralized positioning means so that there is a perfect coupling of both pieces between their protrusions and indentations which make up the correct closing and attaching of both of the elements to link.

In the example, the positioning means are the apertures 106 and 106' on the plain cutting face of the anterior armor 2 and the bolts 6 and 6' with their respective apertures 106 and 106'.

From the manufacturing point of view, in order to produce the anti-vandalism padlocks introduced by this invention, the anterior 2 and posterior 3 armors may be mechanized on metallic pieces of, for instance, steel, bronze or the like, made of an aluminum alloy through an injection process, etc. Another alternative is through the injection of polymers in specially made molds. To this end, engineering plastics or high resistance polymers such as Nylon 66 ® with glass fiber, may be considered for padlock manufacturing, as they need a high safety level.

Figure 7:
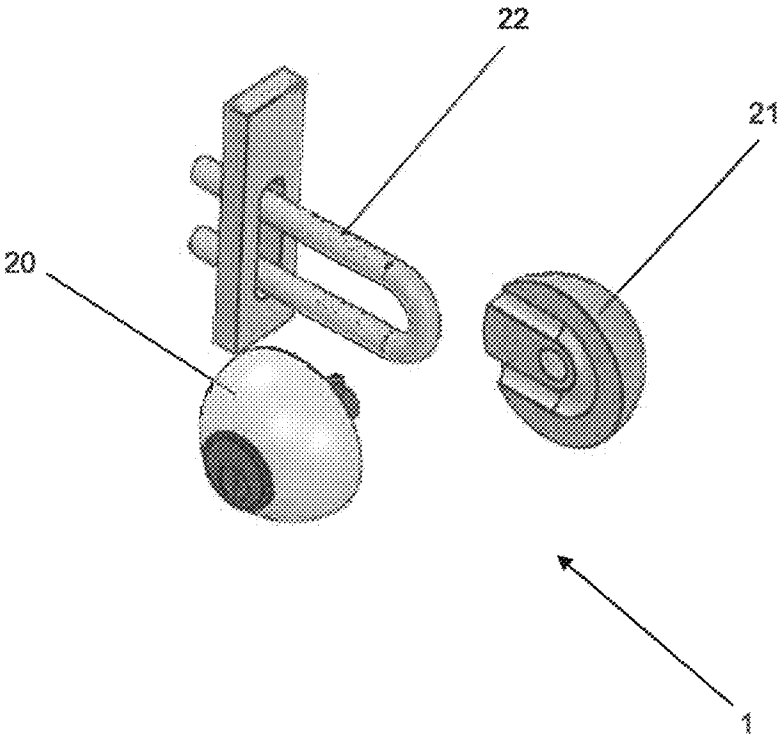
FIG. 7 shows the example of an open anti-vandalism padlock closing a bolt.
Figure 8:
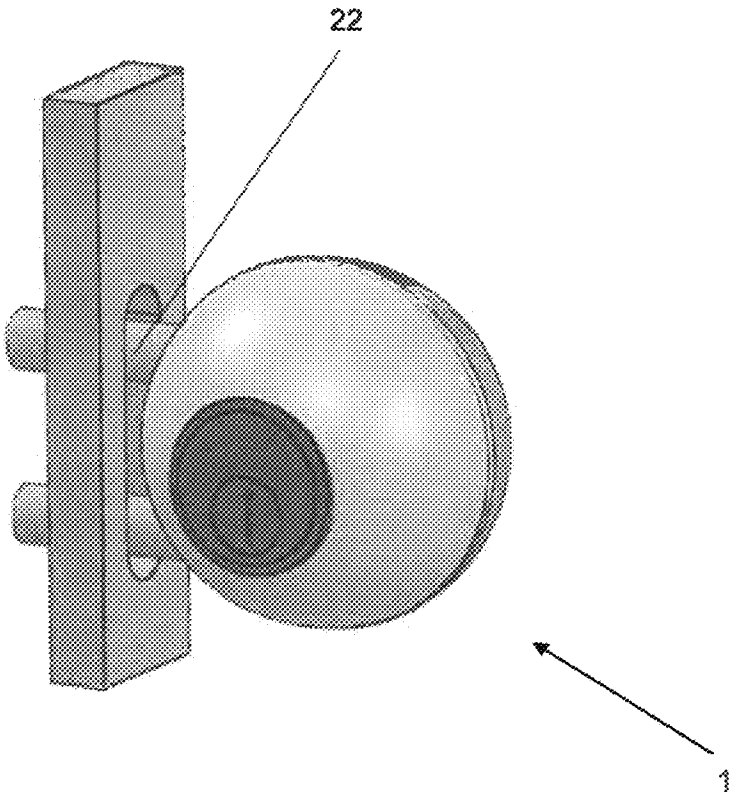
FIG. 8 shows the same example of a closed anti-vandalism padlock as FIG. 7 blocking a bolt.
Figure 9:
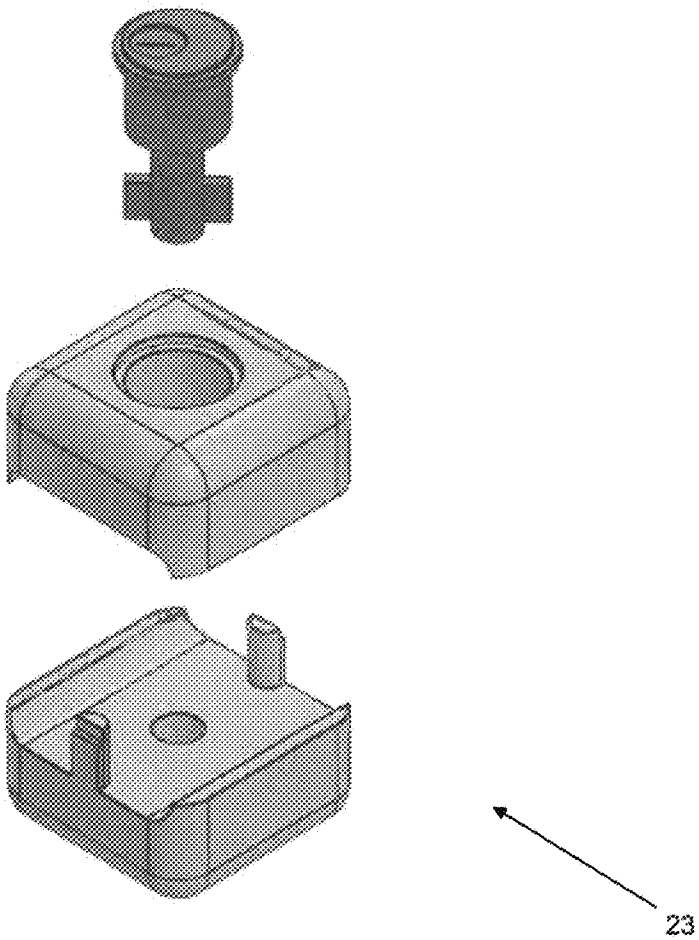
FIG. 9 shows a downward perspective view of a second example of an open anti-vandalism padlock.

FIGS. 7 and 8 show another example of anti-vandalism padlock 1, where their armors 20 and 21 can be seen blocking the bolt 22. FIG. 9 shows a downward perspective view of a second example of an open anti-vandalism padlock.

Figure 10:
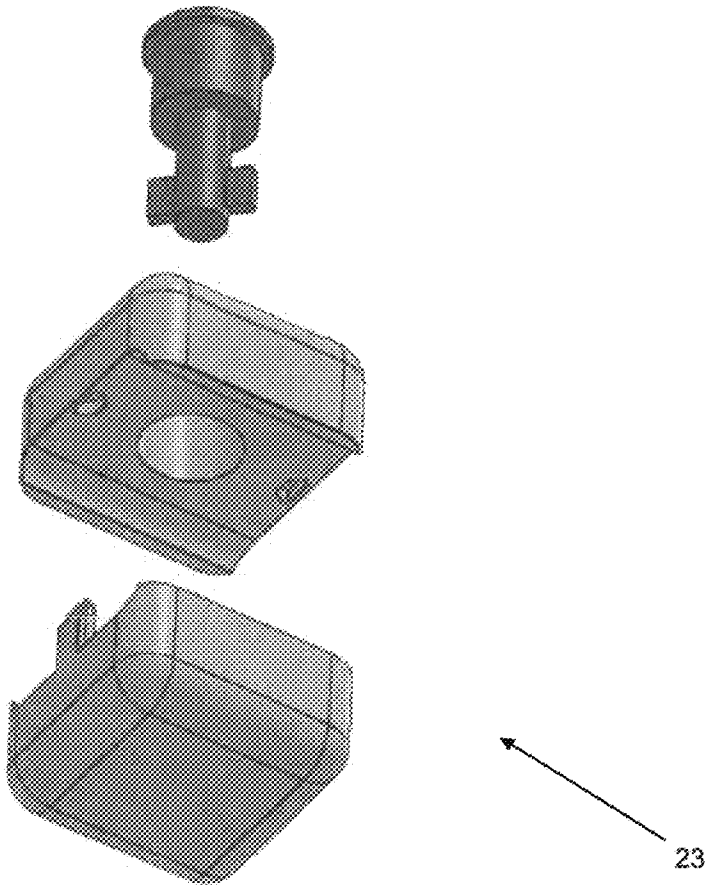
FIG. 10 shows an upward perspective view of the second example of an open anti-vandalism padlock.
Figure 11:
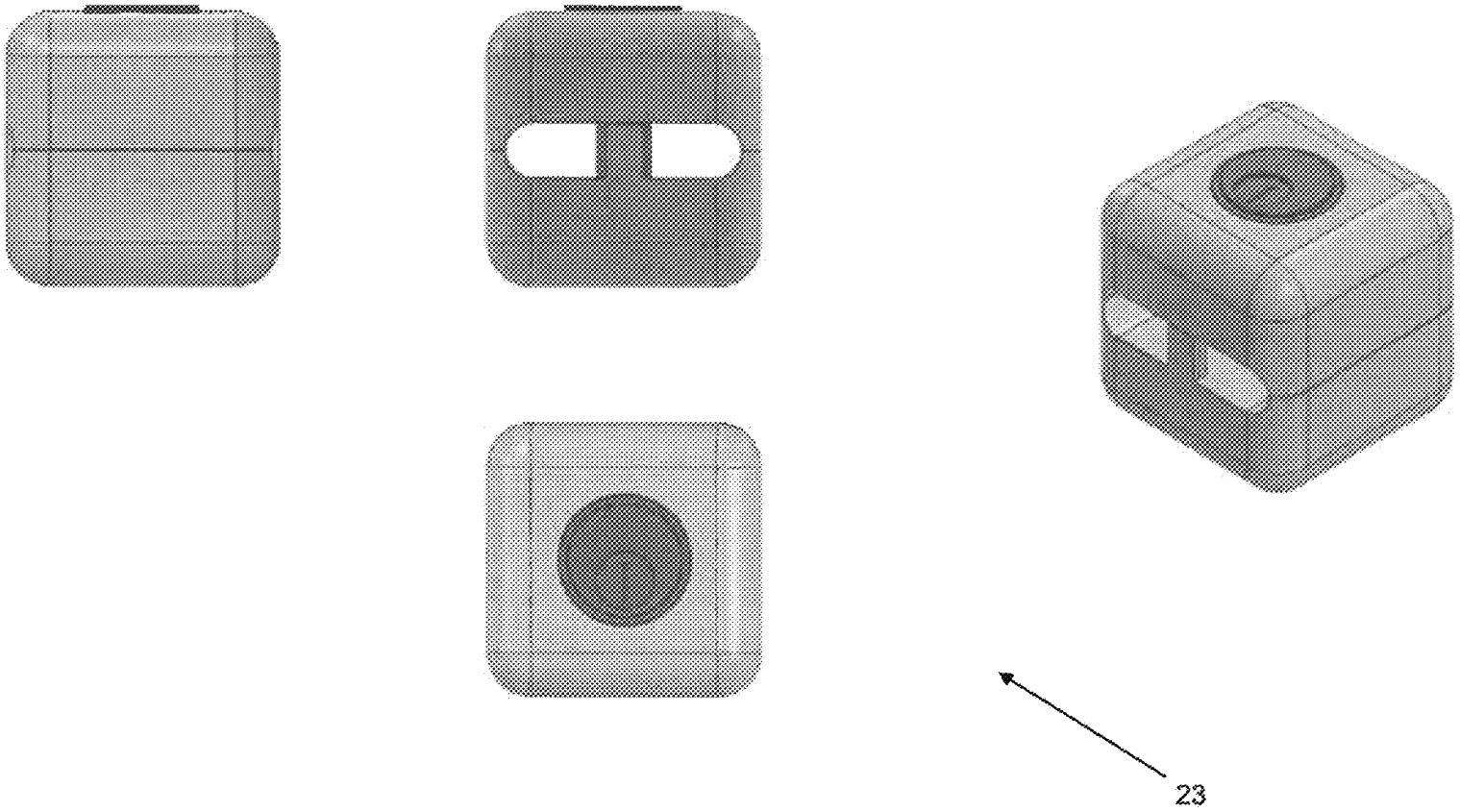
FIG. 11 shows multiple perspective views of a closed anti-vandalism padlock.

In order to conclude the description and with FIGS. 9, 10 and 11 a second example may be introduced (reference number 23). Conceptually it relates to an anti-vandalism padlock as the one described above. However, its tridimensional development shows a cubic shape, in this case with round edges.

Figure 12:
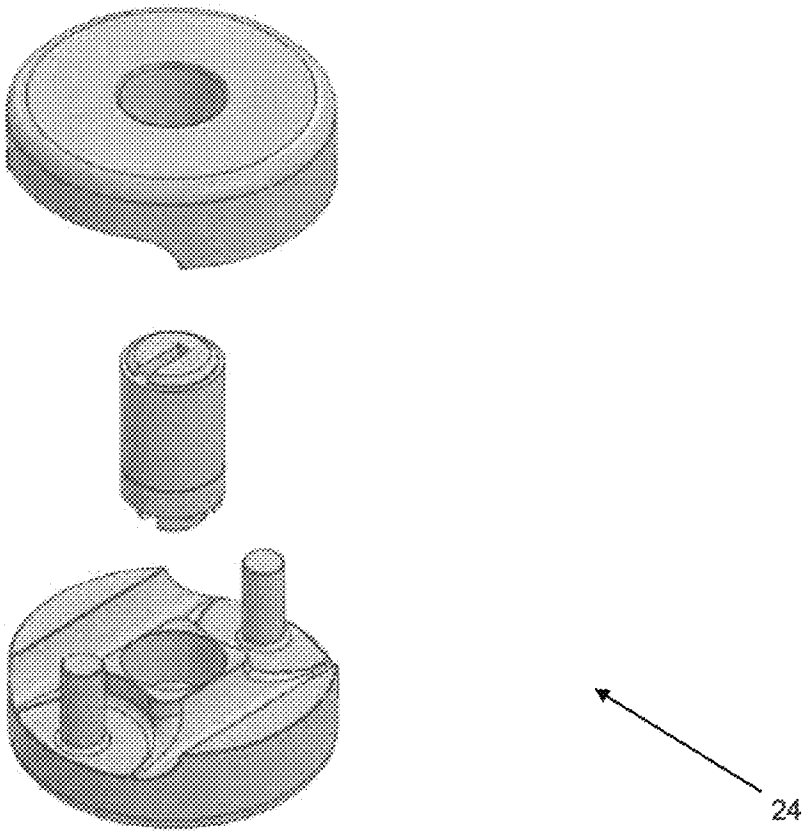
FIG. 12 shows a downward perspective view of a third example of an open anti-vandalism padlock.
Figure 13:
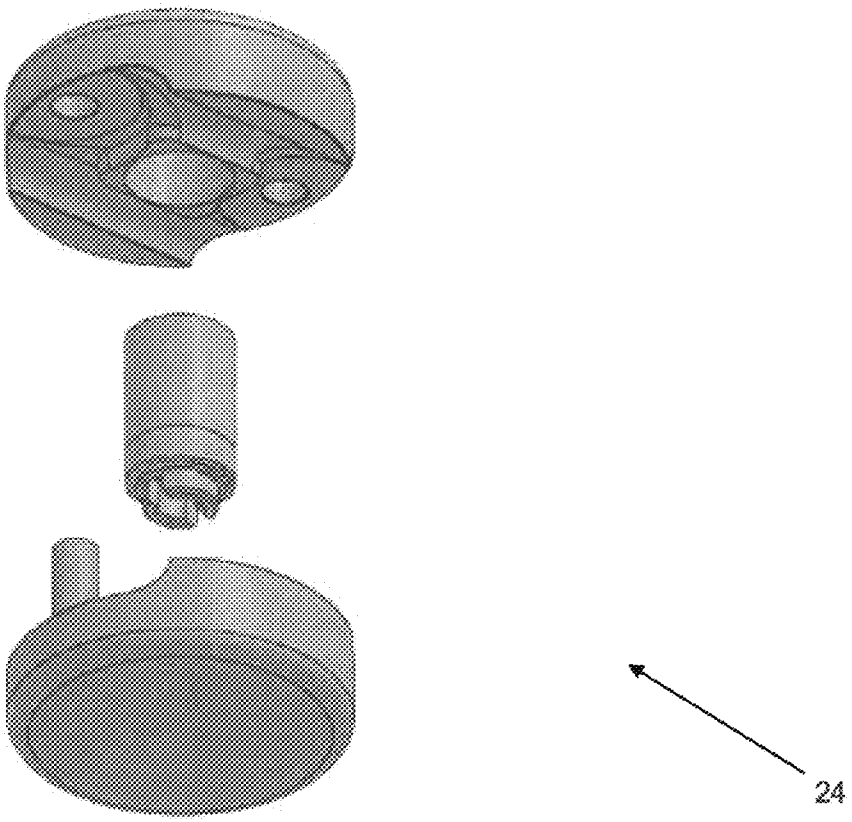
FIG. 13 shows an upward perspective view of a third example of an open anti-vandalism padlock.
Figure 14:
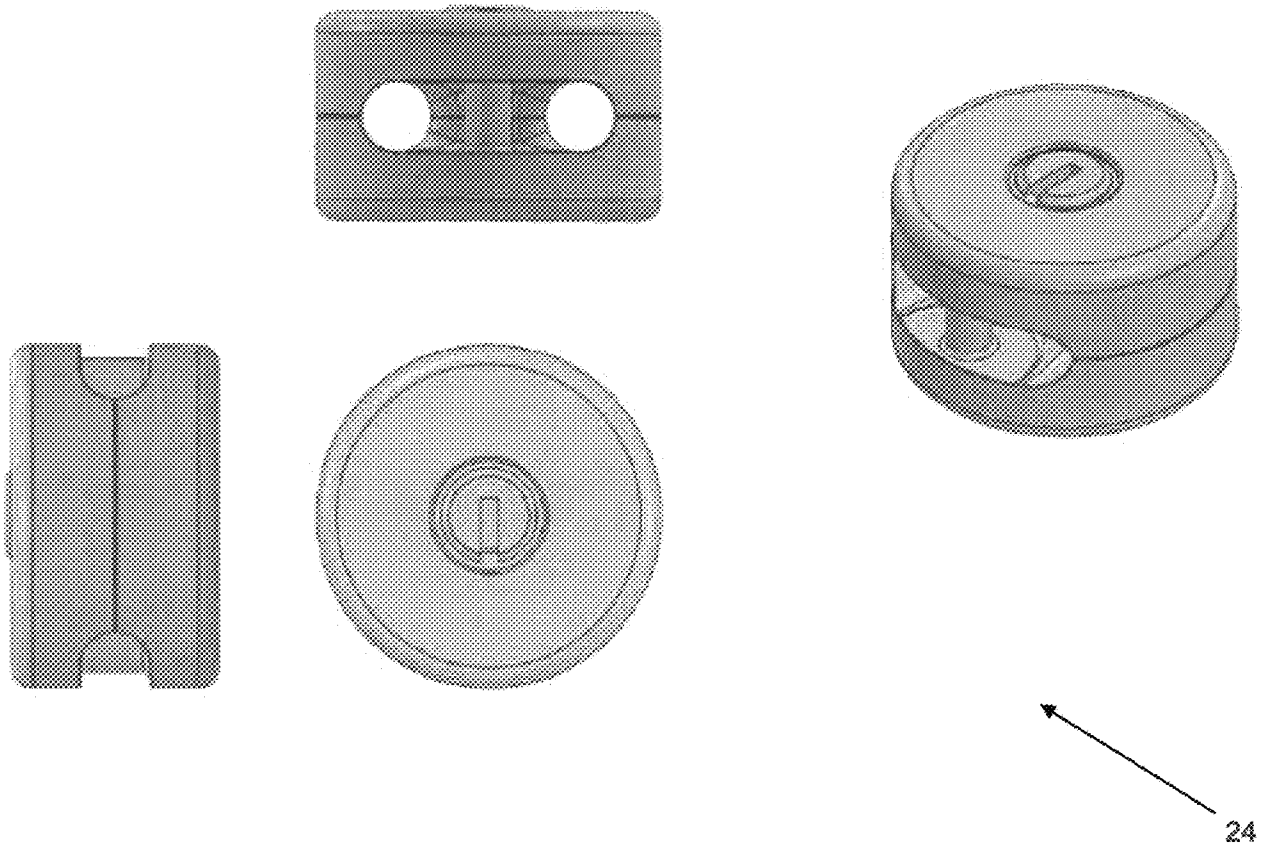
FIG. 14 shows multiple views in perspective of the third example of a closed anti-vandalism padlock.

FIGS. 12, 13 and 14 introduce a third example (reference number 24). In this case, anti-vandalism padlock 24 introduces a tridimensional development with a short cylindrical shape, with round edges in this case.

Figure 15:
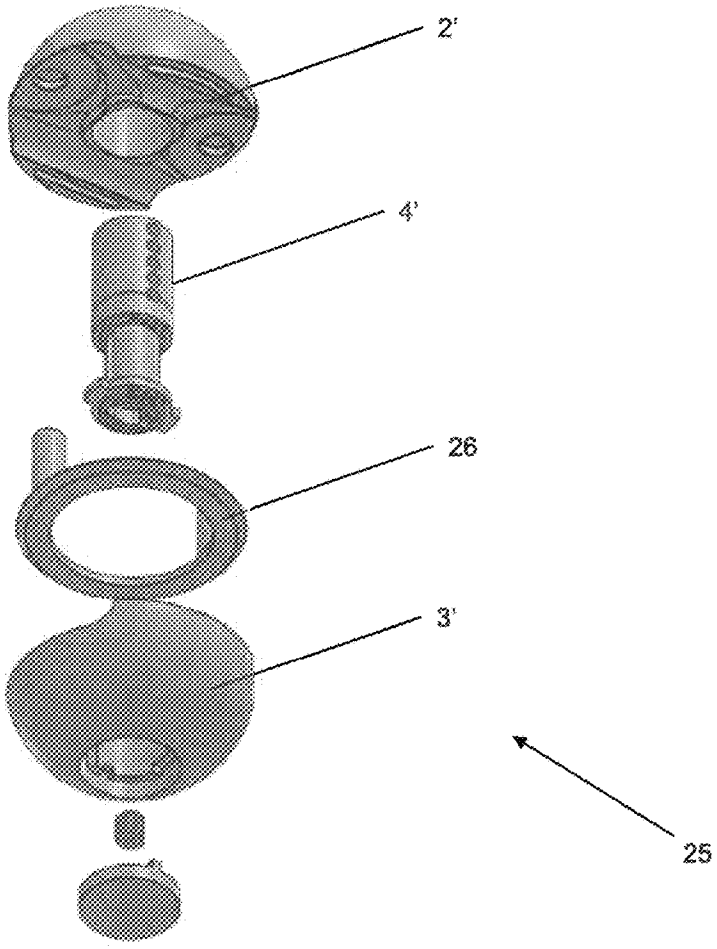
FIG. 15 shows an upward perspective view of a forth example of an open anti-vandalism padlock.
Figure 16:
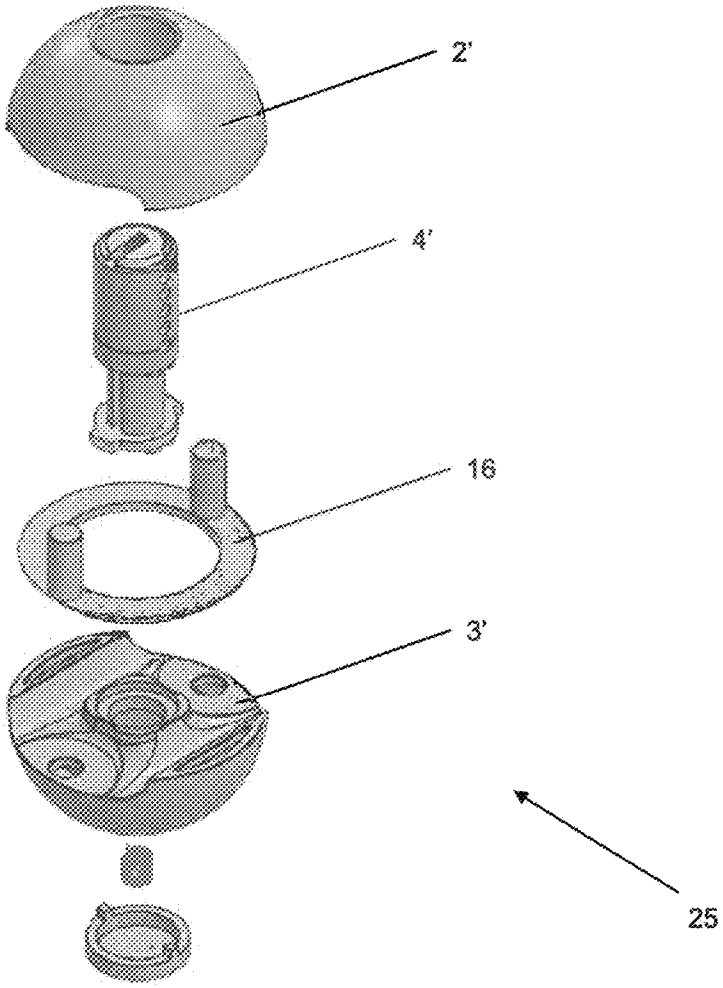
FIG. 16 shows a downward perspective view of the fourth example of an open anti-vandalism padlock.

Finally, FIGS. 15 and 16 introduce a fourth example of the anti-vandalism padlock (reference number 25). In this example an improved locking device was used, with respect to the one used in FIG. 1. Conceptually it is the same. However, in this case, details in the blocking mechanism were introduced as well as a metallic core in the posterior armor 3' (inferior in the FIGS. 15 and 16), and there may be a coupling counterpart in the anterior armor 2' (superior in the FIGS. 15 and 16).

This metallic core 26 is intended to bolster the padlock from the very beginning, for the case of armors made of polymers through injection processes. The metallic core 26 may be made of any metal, steel preferably.

As any expert in this subject would understand, this patent application is aimed at describing the concept of the invention. Nevertheless, it is worth mentioning that any modifications of this invention, either in its size, composition, shape, adaptations, etc., following the same development concept and included in the protection herein shall be enclosed by this patent application.

Having described in detail this invention, determined its nature and the way it should be put into practice, it is hereby claimed as exclusive property and right:

1. An anti-vandalism padlock, comprising:

A) an anterior armor comprising a first cutting face and an exterior face, said first cutting face comprising first and second semicircular indentations and first and second straight indentations, wherein each of the first and second semicircular indentations comprises a groove having a semicircular pattern between a first terminus and a second terminus, wherein the first semicircular indentation and the first straight indentation share a common first terminus and the first semicircular indentation and the second straight indentation share a common second terminus, wherein the second semicircular indentation and the first straight indentation share a common third terminus and the second semicircular indentation and the second straight indentation share a common fourth terminus;

B) a posterior armor comprising a second cutting face comprising third and fourth semicircular indentations and third and fourth straight indentations, wherein each of the third and fourth semicircular indentations comprises a groove having a semicircular pattern between a first terminus and a second terminus, wherein the third semicircular indentation is complementary to the first semicircular indentation and the first straight indentation is complementary to the third straight indentation, wherein the fourth semicircular indentation is complementary to the second semicircular indentation and the second straight indentation is complementary to the fourth straight indentation, wherein the third semicircular indentation and the third straight indentation share a common first terminus on the posterior armor and the third semicircular indentation and the fourth straight indentation share a common second terminus on the posterior armor, wherein the fourth semicircular indentation and the third straight indentation share a common third terminus on the posterior armor and the fourth semicircular indentation and the fourth straight indentation share a common fourth terminus on the posterior armor; and C) a tumbler cam lock for coupling said anterior armor to said posterior armor through an orifice on said anterior armor, wherein said posterior armor comprises a latching aperture for securing said tumbler cam lock.

2. The anti-vandalism padlock set forth in claim 1, wherein said first cutting face and said second cutting face are configured to be coupled together.

3. The anti-vandalism padlock set forth in claim 1, wherein said anterior armor further comprises first and second posts that are diametrically opposite to each other.

4. The anti-vandalism padlock set forth in claim 3, wherein said posterior armor further comprises first and second apertures that are diametrically opposite to each other.

5. The anti-vandalism padlock set forth in claim 4, wherein said anterior armor and said posterior armor have symmetry so that said first and second posts and said first and second apertures provide positioning alignment of the anterior and the posterior armors.

6. The anti-vandalism padlock set forth in claim 1, wherein said first and second semicircular indentations and said third and fourth semicircular indentations receive respective links of at least one chain.

7. The anti-vandalism padlock set forth in claim 1, wherein said first and its complementary third straight indentations and said second and its complementary fourth straight indentations are configured to form a first and second orifice for receiving and securing straight elements.

8. The anti-vandalism padlock set forth in claim 1, wherein said tumbler cam lock is cylindrical.

9. The anti-vandalism padlock set forth in claim 1, wherein said anterior armor and said posterior armor have a geometric exterior cubic shape.

10. The anti-vandalism padlock set forth in claim 1, wherein said anterior armor and said posterior armor have a geometric exterior cylindrical shape.

11. The anti-vandalism padlock set forth in claim 1, wherein said anterior armor and said posterior armor are shaped as hemispheres externally.

12. The anti-vandalism padlock set forth in claim 1, wherein said anterior armor and said posterior armor are made of steel, bronze, or aluminum alloy.

13. The anti-vandalism padlock set forth in claim 1, wherein said anterior armor and said posterior armor are made of engineered plastics or high resistance polymers.

14. An anti-vandalism padlock comprising:

an anterior armor comprising a first cutting face and an exterior face, said anterior armor comprising an orifice from said exterior face to said first cutting face, wherein said first cutting face comprises:

a first semicircular indentation on a first side, wherein the first semicircular indentation comprises a groove having a semicircular pattern between a first terminus and a second terminus, wherein said first terminus is located at a first end of an outer edge of the first cutting face and said second terminus is located at a second end of the outer edge of the first cutting face;

a second semicircular indentation on an opposing side to said first side, wherein the second semicircular indentation comprises a groove having a semicircular pattern between a first terminus and a second terminus, wherein said first terminus is located at a third end of the outer edge of the first cutting face and said second terminus is located at a fourth end of the outer edge of the first cutting face;

a first straight indentation adjoining the first terminus of the first semicircular indentation and the first terminus of the second semicircular indentation;

a second straight indentation adjoining the second terminus of the first semicircular indentation and the second terminus of the second semicircular indentation;

a posterior armor comprising a second cutting face, said posterior armor comprising a latching aperture on said second cutting face, wherein said second cutting face comprises:

a third semicircular indentation on a first side that is complementary to said first semicircular indentation on said anterior armor, wherein the third semicircular indentation comprises a groove having a semicircular pattern between a first terminus and a second terminus, wherein said first terminus is located at a first end of an outer edge of the second cutting face and said second terminus is located at a second end of the outer edge of the second cutting face;

a fourth semicircular indentation on an opposing side to said first side that is complementary to the second semicircular indentation on said anterior armor, wherein the fourth semicircular indentation comprises a groove having a semicircular pattern between a first terminus and a second terminus, wherein said first terminus is located at a third end of the outer edge of the second cutting face and said second terminus is located at a fourth end of the outer edge of the second cutting face;

a third straight indentation that is complementary to the first straight indentation on said anterior armor, the third straight indentation adjoining the first terminus of the third semicircular indentation and the first terminus of the fourth semicircular indentation;

a fourth straight indentation that is complementary to the second straight indentation on said anterior armor, the second straight indentation adjoining the second terminus of the third semicircular indentation and the second terminus of the fourth semicircular indentation; and a tumbler cam lock for coupling said anterior armor through said orifice to said latching aperture in said posterior armor.

15. The anti-vandalism padlock set forth in claim 14, wherein said second straight indentation is parallel to said first straight indentation.

16. The anti-vandalism padlock set forth in claim 14, wherein said first cutting face and said second cutting face comprises at least one post and aperture combination for aligning said posterior armor with said anterior armor.

17. The anti-vandalism padlock set forth in claim 14, wherein said orifice is centrally located on said anterior armor and said latching aperture is centrally located on said second cutting face of the posterior armor.

18. The anti-vandalism padlock set forth in claim 14, wherein the first and third semicircular indentations are configured to secure a portion of a link of a first chain and the second and fourth semicircular indentations are configured to secure a portion of a link of a second chain when the anterior armor is coupled to the posterior armor.

19. The anti-vandalism padlock set forth in claim 14, wherein the first and third straight indentations are configured to secure a first straight element and the second and fourth straight indentations are configured to secure a second straight element when the anterior armor is coupled to the posterior armor.

20. An anti-vandalism padlock comprising:

an anterior armor comprising a first cutting face and an exterior face, said anterior armor comprising an orifice from said exterior face to said first cutting face, wherein said first cutting face comprises a first semicircular indentation on a first side, wherein the first semicircular indentation comprises a groove having a semicircular pattern between a first terminus and a second terminus, wherein said first terminus is located at a first end of an outer edge of the first cutting face and said second terminus is located at a second end of the outer edge of the first cutting face;

a posterior armor comprising a second cutting face, said posterior armor comprising a latching aperture on said second cutting face, wherein said second cutting face comprises a second semicircular indentation on a first side that is complementary to said first semicircular indentation on said anterior armor, wherein the second semicircular indentation comprises a groove having a semicircular pattern between a first terminus and a second terminus, wherein said first terminus is located at a first end of an outer edge of the second cutting face and said second terminus is located at a second end of the outer edge of the second cutting face;

a tumbler cam lock for coupling said anterior armor through said orifice to said latching aperture in said posterior armor.

21. The anti-vandalism padlock set forth in claim 20, wherein said orifice is centrally located on said anterior armor and said latching aperture is centrally located on said second cutting face of the posterior armor.

* * * * *